US007848676B2

(12) United States Patent
Akiyama

(10) Patent No.: US 7,848,676 B2
(45) Date of Patent: Dec. 7, 2010

(54) INTERNAL OUTPUT TYPE IMAGE FORMING APPARATUS

(75) Inventor: Takaya Akiyama, Osaka (JP)

(73) Assignee: Kyocera Mita Corporation (JP)

( * ) Notice: Subject to any disclaimer, the term of this patent is extended or adjusted under 35 U.S.C. 154(b) by 165 days.

(21) Appl. No.: 12/341,151

(22) Filed: Dec. 22, 2008

(65) Prior Publication Data

US 2009/0169242 A1 Jul. 2, 2009

(30) Foreign Application Priority Data

Dec. 27, 2007 (JP) ..... 2007-337825
Dec. 27, 2007 (JP) ..... 2007-337826

(51) Int. Cl.
*G03G 15/00* (2006.01)

(52) U.S. Cl. ..... 399/107

(58) Field of Classification Search ..... 399/107, 399/393, 405, 411; 347/108, 152
See application file for complete search history.

(56) References Cited

U.S. PATENT DOCUMENTS 6,374,066 B1 * 4/2002 Smith et al. ..... 399/107
6,690,901 B2 * 2/2004 Katsuyama et al. ..... 399/107
7,486,903 B2 * 2/2009 Asakawa ..... 399/107 X
7,489,886 B2 * 2/2009 Ito ..... 399/107
7,496,313 B2 * 2/2009 Saito et al. ..... 399/107
7,711,311 B2 * 5/2010 Watanabe et al. ..... 399/405
7,751,729 B2 * 7/2010 Watanabe et al. ..... 399/107 X
2006/0008292 A1 * 1/2006 Watanabe ..... 399/107

FOREIGN PATENT DOCUMENTS

JP 2004-355019 12/2004
JP 2006-58689 3/2006

* cited by examiner

*Primary Examiner*—Sandra L Brase
(74) *Attorney, Agent, or Firm*—Gerald E. Hespos; Michael J. Porco

(57) ABSTRACT

An image forming apparatus includes a main apparatus body, an image reading block located above the main apparatus body, a sheet output portion provided with a sheet output tray onto which each sheet is ejected upon completion of image forming operation, the sheet output portion being located between the main apparatus body and the image reading block and opening at least frontward to permit retrieval of sheets from the sheet output tray, and a front cover section provided on a front side of the main apparatus body, the front cover section including front openable covering members. The front cover section has a striped portion having a surface in which ridges and furrows are formed and a flat portion having a flat surface. The flat portion includes a first flat portion located in an area adjacent to the sheet output tray.

12 Claims, 4 Drawing Sheets

INTERNAL OUTPUT TYPE IMAGE FORMING APPARATUS

BACKGROUND OF THE INVENTION

1. Field of the Invention

The present invention relates to an internal output type image forming apparatus such as a printer, a copying machine, a facsimile machine or a hybrid machine provided with above functions.

2. Description of the Related Art

Conventionally known image forming apparatuses employing so-called internal output design are so configured that an image reading block is disposed above a main apparatus body which incorporates a built-in image forming block and paper (sheet) feed mechanism, with a sheet output portion provided between the image reading block and the main apparatus body, and a front cover section is provided on a front side of the main apparatus body as described in Japanese Unexamined Patent Publication Nos. 2006-58689 and 2004-355019, for example. In this kind of image forming apparatus, each sheet carrying a finished image formed inside the main apparatus body is ejected onto an output tray of the sheet output portion which is provided between the image reading block and the main apparatus body.

Generally, the front cover section includes an access cover for the image forming block and external cover panels of a plurality of vertically arranged paper cassettes. Typically, each of the paper cassettes has a drawer-type boxlike structure which can be pulled out frontward and pushed in rearward when replenishing sheets of paper, for instance. To permit a user to easily slide the paper cassettes frontward and rearward, each of the paper cassettes has a handle which is located on the front side of the main apparatus body.

Compared to an image forming apparatus of a type configured to output successive sheets to the top or side of the apparatus, the internal output type image forming apparatus has a problem that it is structurally difficult for the user to recognize where the sheets are output upon completion of image forming operation. This means that the internal output type image forming apparatus has a problem concerning ease of access to finished printouts. In addition, the front cover section covering the front side of the main apparatus body is configured to form a generally flat plane. Thus, the user standing in front of the image forming apparatus is apt to recognize the entirety of the front side of the main apparatus body as a simple flat surface. Since handles of paper cassettes could appear at a glance as if buried in the flat surface of the main apparatus body, the user might not be able to instantly recognize the location of each handle.

It will be understood from the above discussion that the conventional internal output type image forming apparatus does not provide good accessibility to the sheet output portion and paper cassettes for wide variety of users, especially for weak-sighted users, for instance. Currently, image forming apparatuses are required to offer operability with further enhanced user-friendliness.

SUMMARY OF THE INVENTION

In view of the foregoing, it is an object of the present invention to provide an internal output type image forming apparatus which offers enhanced ease of user access to specific locations of the apparatus.

An image forming apparatus according to a principal feature of the invention comprises a main apparatus body having a boxlike structure incorporating in an internal space thereof an image forming block and a sheet feed section, an image reading block located above the main apparatus body, a sheet output portion provided with a sheet output tray onto which a sheet is ejected upon completion of image forming operation, the sheet output portion being located between the main apparatus body and the image reading block and opening at least frontward to permit retrieval of the sheet from the sheet output tray, and a front cover section provided on a front side of the main apparatus body, the front cover section including front openable covering members. The front cover section includes a striped portion having a surface in which ridges and furrows are formed and a flat portion having a flat surface, the flat portion including a first flat portion located in an area adjacent to the sheet output tray.

DETAILED DESCRIPTION OF THE PREFERRED EMBODIMENT

A specific embodiment of the present invention is now described in detail with reference to the accompanying drawings.

Figure 1:
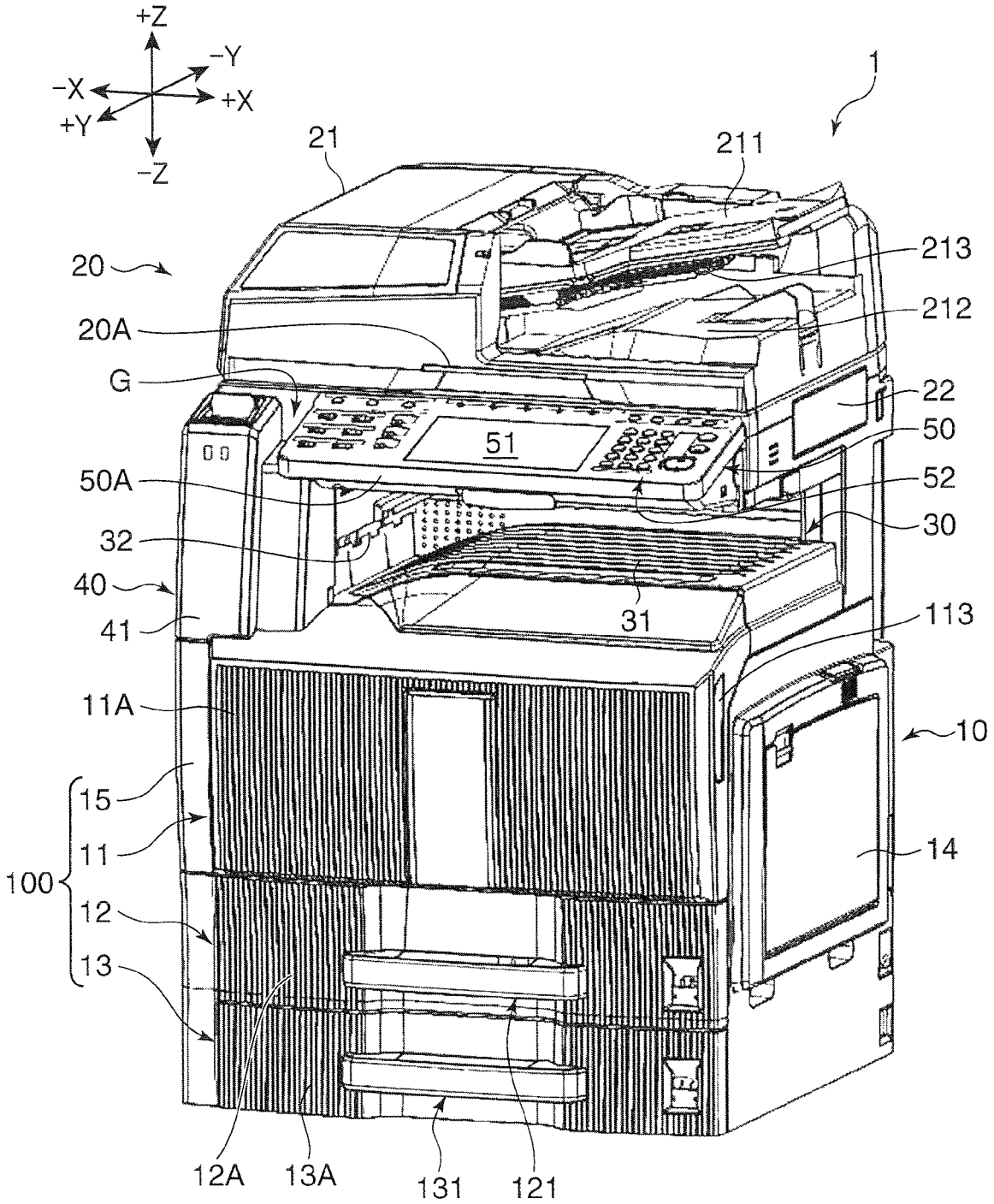
FIG. 1 is a perspective view showing the external appearance of a copying machine which is an example of an image forming apparatus according to a preferred embodiment of the invention.

FIG. 1 is a perspective view showing the external appearance of a copying machine 1 which is an example of an image forming apparatus according to the embodiment of the present invention. As depicted in FIG. 1 and the other drawings, an "X-X direction" denotes a left-right direction, a "Y-Y direction" denotes a left-right direction, and a "Z-Z direction" denotes an up-down direction. In particular, a "+X direction" represents a rightward direction, a "−X direction" represents a leftward direction, a "+Y direction" represents a frontward direction, a "−Y direction" represents a rearward direction, a "+Z direction" represents an upward direction, and a "−Z direction" represents a downward direction.

The copying machine 1 is a so-called internal output type copying machine comprising a box-shaped main apparatus body 10 incorporating a built-in image forming block 70 and paper (sheet) feed section 60, an image reading block 20 disposed above the main apparatus body 10 and a frontward-opening sheet output portion 30 which is provided between the main apparatus body 10 and the image reading block 20 and configured such that each successive sheet carrying a finished image can be ejected to the sheet output portion 30 and retrieved therefrom.

Provided on a front side of the main apparatus body 10 is a front cover section 100 including a plurality of vertically arranged covering members which can be opened frontward. In this embodiment, the covering members of the front cover section 100 include an access cover 11 having an external cover panel 11A located at an uppermost part of the front cover section 100, external cover panels 12A, 13A of first and second paper cassettes 12, 13 which are disposed below the access cover 11 as if in a vertically stacked fashion, as well as a vertically extending striplike panel 15 located at a left side (as viewed from front) of the front cover section 100.

The access cover 11 has a recessed handle 113 formed in a right-hand end thereof and a pivot axis at a left end so that the access cover 11 can be swung frontwardly leftward to permit access to the interior. On the other hand, the first and second paper cassettes 12, 13 are mounted in the main apparatus body 10 in such a manner that the paper cassettes 12, 13 can be pulled out frontward. The first and second paper cassettes 12, 13 are provided with handles 121, 131 by which a user can pull out and push in the respective paper cassettes 12, 13.

The image reading block 20 is located above the main apparatus body 10 with a space for the sheet output portion 30 provided in between. The image reading block 20, which is supported by a column portion 40 located at the left of a top surface of the main apparatus body 10 and a side wall located at the rear of the top surface of the main apparatus body 10, includes an automatic document feeder unit 21 for feeding a document to be scanned to a document scanning position and subsequently ejecting the document and a scanner unit 22 for scanning (or reading) an image of the document. Shown in this embodiment is an example in which the automatic document feeder unit 21 is provided with an document tray 211 on which the document to be scanned is placed, a document output tray 212 onto which the scanned document is ejected and an intermediate output tray 213 onto which the document is ejected for temporary storage in the case of two-sided scanning.

The sheet output portion 30 is a site where each sheet carrying a finished image formed within the main apparatus body 10 based on the document image scanned by the image reading block 20 is delivered. The sheet output portion 30 is provided with a sheet output tray 31 and a sheet output port 32. The sheet output port 32 is a slitlike opening formed in a right side surface (which is the surface facing the sheet output portion 30) of the column portion 40. Each sheet is ejected from the main apparatus body 10 onto the sheet output tray 31 through this slitlike opening upon completion of successive image forming operation. The sheet output tray 31 forms a sheet receiving surface for receiving and holding sheets output through the sheet output port 32. The sheet receiving surface of the sheet output tray 31 has a partially inclined part gently sloping down from right to left in front view, a left end of the inclined part nearest the sheet output port 32 being the lowest. Due to the presence of this inclined part, the sheets ejected through the sheet output port 32 in a normal sheet feeding direction toward the sheet output tray 31 settle thereon in such a fashion that rear ends of the sheets align in the vicinity of the sheet output port 32.

The column portion 40 located to the left of the sheet output portion 30 is a structural part supporting the image reading block 20, serving also to cover a paper path (third paper path 613) located close to the sheet output port 32. The column portion 40 is provided with a column cover 41 for covering a front surface thereof. The column cover 41 is arranged flush with the striplike panel 15 of the main apparatus body 10, the column cover 41 and the striplike panel 15 extending substantially uninterruptedly in the up-down direction.

Mounted on a front surface of the image reading block 20 is an operating panel 50 which is so arranged as to take up part of a space located at the front of the image reading block 20 just above the sheet output tray 31. There is provided a gap G between the operating panel 50 and the column portion 40. The user is allowed to visually inspect part of the internal output type sheet output tray 31 through this gap G from top. Especially because the gap G is located approximately immediately above the sheet output port 32 at a position corresponding to the lowest left end of the sheet output tray 31 where the rear ends of the output sheets are aligned, the user can visually inspect whether any sheet is present on the sheet output tray 31 or currently being ejected thereonto, for instance, in a reliable fashion.

The operating panel 50 is a device which permits the user to enter various operating commands and settings. In the image forming apparatus of the present embodiment, the operating panel 50 is provided with a display screen 51 made of a liquid crystal display (LCD) or the like for presenting operating buttons and various kinds of information and an operating keypad 52 including instruction keys and numeric keys used for entering various user instructions, such as the number of copies to be produced, a print command, and so on.

Figure 2:
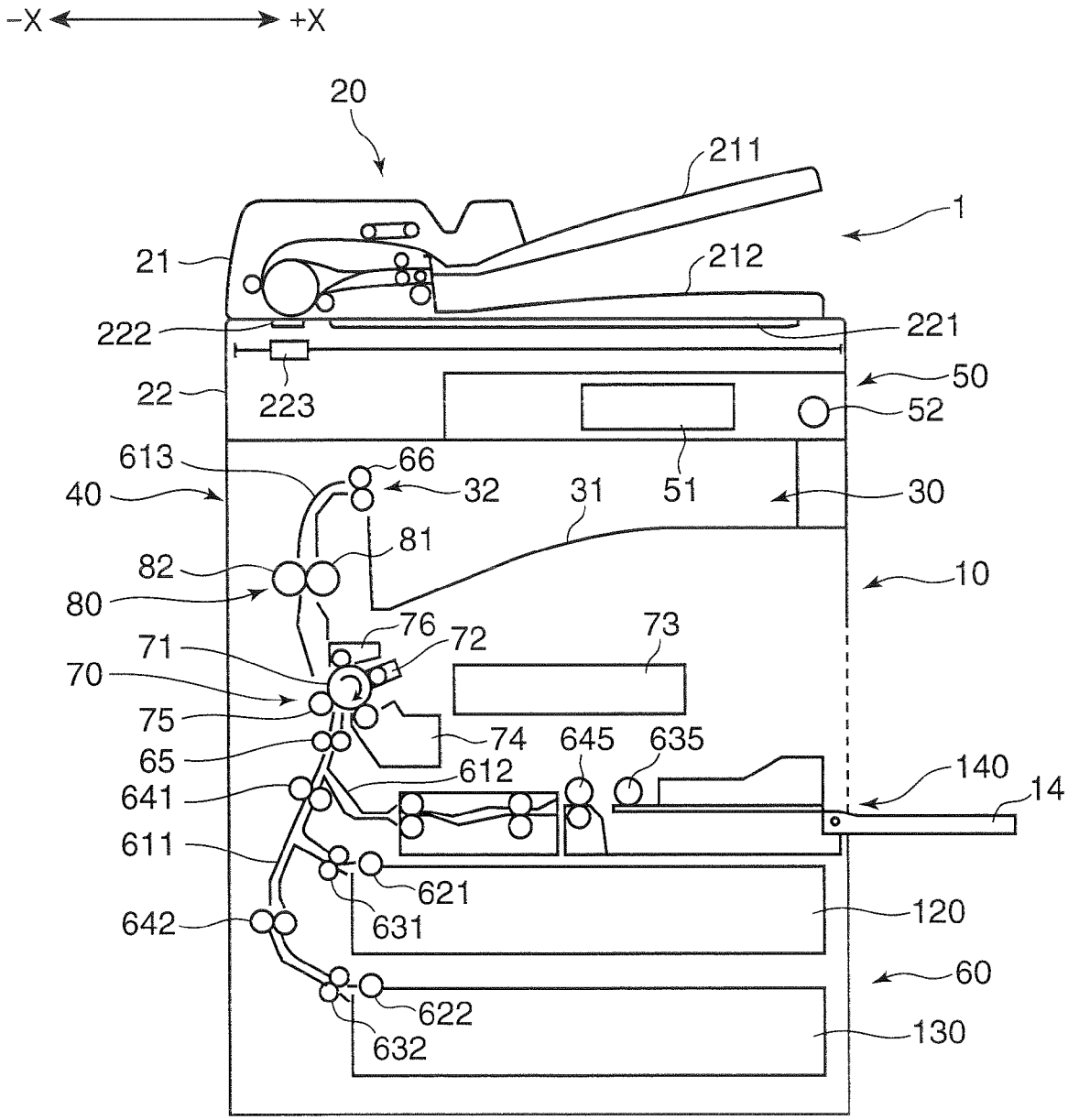
FIG. 2 is a cross-sectional view schematically showing the internal construction of the copying machine.

Internal construction of the copying machine 1 is now described. FIG. 2 is a cross-sectional view schematically showing the internal construction of the copying machine 1. As so far described, the copying machine 1 includes the main apparatus body 10 associated with the column portion 40 mounted on the top surface, the image reading block 20, the sheet output portion 30 and the operating panel 50. The main apparatus body 10 incorporates in an internal space thereof the paper feed section 60, the image forming block 70 and a fixing unit 80.

The image reading block 20 includes the scanner unit 22 and the automatic document feeder unit 21 which is disposed above the scanner unit 22. The scanner unit 22 has in an internal space thereof a movable frame 223 fitted with an exposure lamp for projecting light onto an original. Although not illustrated, the scanner unit 22 incorporates also a charge-coupled device (CCD) sensor for generating image data through photoelectric conversion of the light reflected from the document as well as an optical system for guiding the reflected light to the CCD sensor. The scanner unit 22 is further provided on a top surface thereof with first platen glass 221 on which a document to be scanned is manually placed and second platen glass 222 on which an automatically fed document is placed.

The automatic document feeder unit 21 incorporates in an internal space thereof a document feed mechanism which works to feed the document placed on the document tray 211 to the document scanning position and output the document onto the document output tray 212 upon completion of image scanning operation.

The paper feed section 60 of the main apparatus body 10 serves to feed successive sheets of paper (printing paper) to the image forming block 70. The paper feed section 60 includes first and second paper bins 120, 130 accommodating respectively the aforementioned first and second paper cassettes 12, 13 for holding sheets of specific sizes and a manual paper feeder 140 including a manual feed tray 14 which is configured to be flipped down and up on a right side of the main apparatus body 10. Although not illustrated, the first and second paper bins 120, 130 are provided with cursors for exactly positioning reams (or sheets of paper) as well as lifters for elastically lifting the stacked sheets such that uppermost sheets come into contact with below-mentioned pickup rollers 621, 622, respectively.

The paper feed section 60 thus configured is connected to the sheet output port 32 by a paper transport mechanism through the image forming block 70 and the fixing unit 80, the paper transport mechanism including a first paper path 611 routed from the first and second paper bins 120, 130 to the image forming block 70, a second paper path 612 routed from the manual paper feeder 140 to the image forming block 70 and the aforementioned third paper path 613 routed from the image forming block 70 to the sheet output port 32.

Located above a sheet pickup side (left side) of the first and second paper bins 120, 130 are the aforementioned pickup rollers 621, 622 for pulling out each successive sheet from the first and second paper cassettes 12, 13 and feed roller pairs 631, 632 provided downstream of the pickup rollers 621, 622, respectively. The feed roller pairs 631, 632 serve to successively feed the sheets into the first paper path 611.

The first paper path 611 is provided with transport roller pairs 641, 642 for transporting each sheet toward the image forming block 70. The second paper path 612 is provided with a feed roller 635 for pulling in a manually fed sheet and a transport roller pair 645 for transporting the manually fed sheet toward the image forming block 70. At a downstream end of the first paper path 611, there is provided a registration roller pair 65 by which the sheet is kept standby immediately upstream of the image forming block 70 until further fed thereinto. Also, at a downstream end of the third paper path 613, there is provided an output roller pair 66 for further transporting (ejecting) the sheet into the sheet output portion 30. The sheet output port 32 is formed to run parallel to the paper feed section 60.

The image forming block 70 carries out operation for transferring a toner image onto the sheet fed from the paper feed section 60 based on the image data obtained by the image reading block 20. The image forming block 70 includes a photosensitive drum 71 mounted rotatably about its own axis, a charging unit 72 disposed face to face with a cylindrical outer surface of photosensitive drum 71, an exposure unit 73, a developing unit 74, an image transfer roller 75 and a cleaning unit 76.

The image forming block 70 forms an electrostatic latent image on the cylindrical outer surface of the photosensitive drum 71 and then converts the electrostatic latent image into a toner image. The photosensitive drum 71 is preferably an amorphous silicon photosensitive drum having an amorphous silicon layer formed by depositing amorphous silicon on the cylindrical outer surface.

The charging unit 72 uniformly charges the cylindrical outer surface of the photosensitive drum 71 rotating in clockwise direction about its own axis as viewed from the front side. The charging unit 72 may be of a type which supplies an electric charge to the cylindrical outer surface of the photosensitive drum 71 by corona discharge. Alternatively, the charging unit 72 may be of a type employing a charging roller whose cylindrical outer surface is held in direct contact with the cylindrical outer surface of the photosensitive drum 71 and supplies an electric charge thereto as the charging unit 72 rotates together with the photosensitive drum 71.

The exposure unit 73 projects laser light of which intensity is varied according to a particular exposure pattern defined by the image data onto the cylindrical outer surface of the rotating photosensitive drum 71. Areas of the cylindrical outer surface of the photosensitive drum 71 exposed to the laser light are discharged, or deprived of the electric charge, whereby the electrostatic latent image is formed on the cylindrical outer surface of the photosensitive drum 71 according to the laser light exposure pattern.

The developing unit 74 has a built-in development roller which supplies toner particles to the cylindrical outer surface of the photosensitive drum 71. When supplied to the photosensitive drum 71, the toner particles adheres to areas of the latent image on the cylindrical outer surface of the photosensitive drum 71, thereby forming a visible toner image on the photosensitive drum 71. The developing unit 74 is provided with a detachable toner container which is not illustrated. When the toner in the developing unit 74 is depleted, the developing unit 74 is replenished by additional toner supplied from the toner container.

The image transfer roller 75 and the photosensitive drum 71 together form a nipping part therebetween. The image transfer roller 75 transfers the toner image formed on the cylindrical outer surface of the photosensitive drum 71 onto a sheet which has been transported up to the nipping part. The toner image on the outer surface of the photosensitive drum 71 is positively charged, whereas the image transfer roller 75 supplies a negative charge, which is opposite in polarity with respect to the toner image, to the sheet. Thus, the toner image on the positively charged cylindrical outer surface of the photosensitive drum 71 is peeled off by the negatively charged sheet and transferred thereonto.

The cleaning unit 76 serves to clean the photosensitive drum 71 by removing residual toner particles left on the cylindrical outer surface thereof after a preceding image transfer process. The photosensitive drum 71 whose outer surface has been cleaned by the cleaning unit 76 moves again to charging unit 72 in preparation of a succeeding image forming process.

The fixing unit 80 performs a fixing process on the sheet to which the toner image has been transferred by the image forming block 70 by application of heat and pressure. The fixing unit 80 includes a heat roller 81 provided with a built-in electric heating element and a pressure roller 82, the heat roller 81 and the pressure roller 82 having cylindrical outer surfaces which are arranged face to face with each other, together forming a nipping part therebetween. The sheet carrying the transferred toner image is passed through the nipping part between the driving heat roller 81 and the driven pressure roller 82 rotating in an opposite direction with respect to the heat roller 81. As the sheet passes through the nipping part, the toner image is fixed to the sheet due to the heat and pressure applied by the heat roller 81 and the pressure roller 82, respectively. The sheet carrying the toner image thus fixed is transported through the third paper path 613 and ejected by the output roller pair 66 into the sheet output portion 30.

Figure 3:
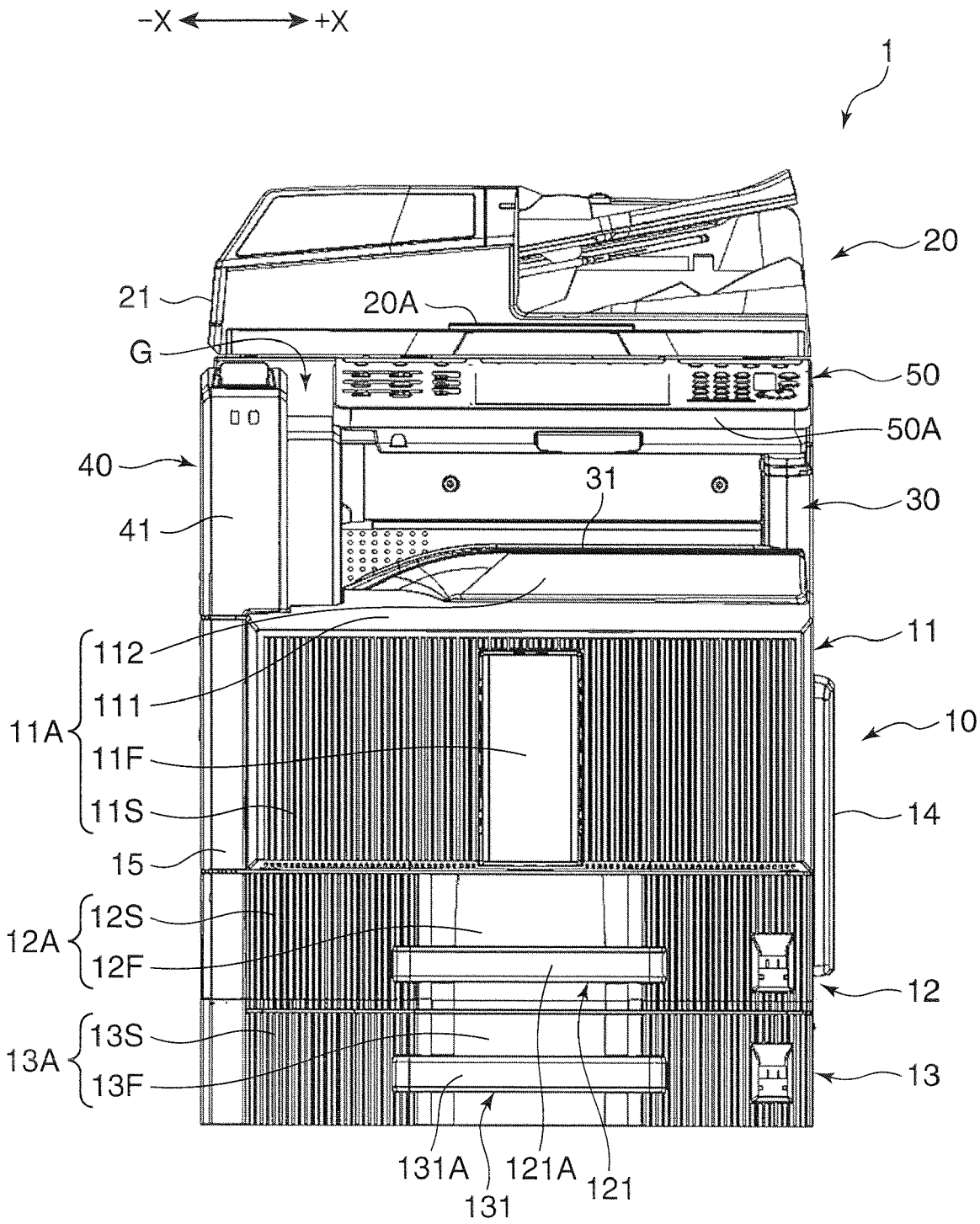
FIG. 3 is a front view of the copying machine.
Figure 4:
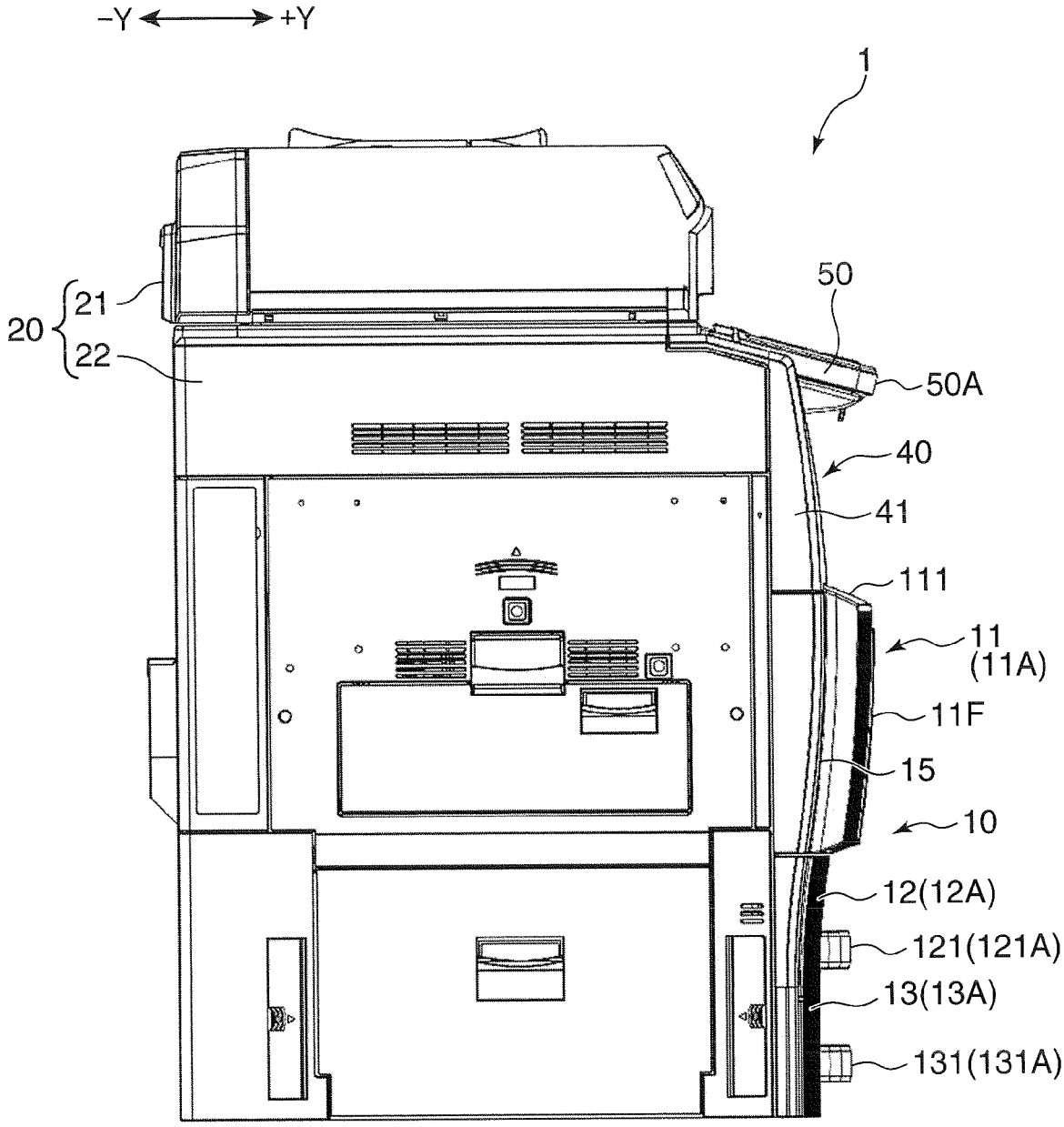
FIG. 4 is a left side view of the copying machine.

Next, the structure of the front cover section 100 shown in FIG. 1 is described in detail with reference to FIGS. 3 and 4. FIG. 3 is a front view of the copying machine 1 shown in FIG. 1, and FIG. 4 is a left side view of the copying machine 1. As previously discussed, the front cover section 100 is configured with the external cover panel 11A of the access cover 11, the external cover panels 12A, 13A of the first and second paper cassettes 12, 13 and the striplike panel 15.

The external cover panel 11A of the access cover 11 includes a striped portion 11S having a front surface in which a plurality of vertically extending low ridges (or shallow furrows) arranged side by side are formed and a flat portion 11F (third flat portion) having a flat front surface. The flat portion 11F has a vertically elongate rectangular shape extending generally all along the height of the striped portion 11S and is located at the middle of the external cover panel 11A in the left-right direction, as if flanked by left and right areas of the striped portion 11S. Typically, the flat portion 11F is used as a display area for a trademark, product logo, manufacturer's emblem or the like, for example.

The ridges and furrows formed in the front surface of the striped portion 11S may have a triangular (V-shaped), U-shaped or rectangular pattern in cross-sectional view, for instance. This pattern is preferably has a stripe pitch and a depth determined within ranges of about 1 mm to 15 mm and about 1 mm to 10 mm, respectively. Another option is to form slits in the furrows of the striped pattern to accelerate heat dissipation from inside the copying machine 1.

The external cover panel 11A further includes a first slant surface 111 and a second slant surface 112 formed above the striped portion 11S. The first and second slant surfaces 111, 112 are flat external surfaces (which correspond to a first flat portion mentioned in the appended claims). The first slant surface 111 is a slant surface which has approximately the same lateral (left to right) width as the striped portion 11S and the flat portion 11F of the access cover 11, the first slant surface 111 connecting to an upper end of the striped portion 11S. The second slant surface 112 is a slant surface interconnecting an upper end of the first slant surface 111 and a front end of the sheet output tray 31, the second slant surface 112 having a slightly larger angle of inclination than the first slant surface 111.

The external cover panel 12A of the first paper cassette 12 includes a striped portion 12S in which a plurality of ridges (or furrows) similar to those of the striped portion 11S of the access cover 11 are formed and a flat portion 12F (second flat portion) having a flat front surface. Likewise, the external cover panel 13A of the second paper cassette 13 includes a striped portion 13S in which a plurality of ridges (or furrows) are formed and a flat portion 13F (second flat portion) having a flat front surface. The flat portions 12F, 13F each have a laterally elongate rectangular shape extending generally all along the height of the respective external cover panels 12A, 13A and are located at the middle thereof in the left-right direction. These flat portions 12F, 13F are located in the back of the handles 121, 131 attached to the first and second paper cassettes 12, 13, respectively.

With the front cover section 100 thus structured, the striped portions 11S, 12S, 13S of the external cover panels 11A, 12A, 13A randomly reflect incident natural light and/or artificial light due to the presence of the narrow-pitched ridges and furrows. On the other hand, the flat portions 11F, 12F, 13F and the first and second slant surfaces 111, 112 which are also flat portions regularly reflect either the natural light or the artificial light. This arrangement permits the user to recognize the flat portions 11F, 12F, 13F and the first and second slant surfaces 111, 112 as visually prominent portions in contrast to the striped portions 11S, 12S, 13S. Particularly because the first and second slant surfaces 111, 112 slope down frontward from the rear, regularly reflected light from these slant surfaces 111, 112 can easily reach the eyesight of the user standing in front of the copying machine 1 under ceiling lighting.

The provision of the first and second slant surfaces 111, 112 in an area adjacent to the sheet output tray 31 combined with an effect of the contrast to the striped portions 11S, 12S, 13S makes it possible for the user to easily recognize the location of the sheet output portion 30. Also, the provision of the flat portions 12F, 13F permits the user to easily recognize the locations of the handles 121, 131 of the first and second paper cassettes 12, 13.

As pointed out in the foregoing discussion, the copying machine 1 is deliberately designed such that parts of the copying machine 1 to be accessed by the user during operation would be clearly noticeable, while other parts of the copying machine 1 having striped surfaces would not show up so strongly. This design of the embodiment helps provide enhanced ease of recognition of the internal output type sheet output tray 31 as well as improved accessibility to the sheet output tray 31 when the user retrieves output sheets therefrom upon completion of the image forming operation, for instance. Additionally, the design of the embodiment serves to improve accessibility to the handles 121, 131 of the first and second paper cassettes 12, 13 and operability thereof required when replenishing sheets of printing paper.

Furthermore, with the flat portion 11F of the access cover 11 structured as described above, the flat portion 11F contiguously connects to the flat portions 12F, 13F of the first and second paper cassettes 12, 13 and, as a consequence, the flat portion 11F appears as if extending upward toward the sheet output portion 30 (sheet output tray 31). This design of the embodiment provides the user with a suggestion on a direction of access to the sheet output portion 30. The user can then use an upper end of the flat portion 11F as a guide when reaching an inner space of the sheet output portion 30 for removing any sheets therefrom.

Described in the following is coloring of the copying machine 1. Overall coloring of the copying machine 1 is based on a dark color like black. In the front cover section 100 of the copying machine 1 having the black-based coloring, the flat portion 11F and front faces 121A, 131A of the handles 121, 131 are silver-coated to impart a bright color. This kind of color arrangement provides further enhanced ease of recognition of the handles 121, 131 and the sheet output portion 30. Additionally, the coloring of the copying machine 1 employing silver on a black background serves to produce an impression of a high-quality product.

The image reading block 20 and the operating panel 50 employ the same silver-on-black coloring as the front cover section 100. Specifically, a lift pull 20A of the automatic document feeder unit 21 of the black-based image reading block 20 is coated with silver. The automatic document feeder unit 21 is configured to be swingable upward about a pivot axis located at a rear end of the scanner unit 22. The user holds the lift pull 20A when swinging up the automatic document feeder unit 21. A front peripheral part 50A of the operating panel 50 is also trimmed with silver. The above-described coloring scheme of the embodiment causes often operated parts of the copying machine 1 to shown up in the prominent color (silver), thereby enhancing the ease of recognition of these parts.

Next, a side-view shape of the copying machine 1 is described with reference to FIG. 4. The column cover 41 of the column portion 40 and the striplike panel 15 of the main apparatus body 10 together form a contiguous bow shape bulging frontward in side view. The external cover panel 11A of the access cover 11 protrudes more frontward than the column cover 41 and the external cover panels 12A, 13A of the first and second paper cassettes 12, 13. This is because the access cover 11 covers the image forming block 70 containing various components of the copying machine 1. Also, the external cover panel 11A of the access cover 11 protrudes more frontward than the front faces 121A, 131A of the handles 121, 131.

In the copying machine 1 thus structured, the flat portion 11F of the access cover 11 constitutes a bulging flat part protruding more frontward than the rest of the access cover 11. It follows that the flat portion 11F of the external cover panel 11A is a part protruding most frontward from the front of the main apparatus body 10.

When installing or relocating the copying machine 1, the frontward bulging external cover panel 11A is apt to hit against a wall surface or other objects. As the external cover panel 11A is provided with the flat portion 11F, however, it is possible to reduce damage to the striped portion 11S even if the external cover panel 11A collide with a nearby object. Also, as the flat portion 11F of the external cover panel 11A is the part protruding most frontward from the front of the main apparatus body 10, the flat portion 11F serves to prevent the front faces 121A, 131A of the handles 121, 131 and the column cover 41 from hitting against the wall surface or the like, thereby protecting those parts of the copying machine 1. Preferably, the external cover panel 11A should be so configured that the flat portion 11F protrudes more frontward than the front peripheral part 50A of the operating panel 50.

While the invention has been discussed with reference to one preferred embodiment heretofore, the invention is not limited to the illustrative embodiment but is applicable in various other ways. Described hereinbelow are some examples of variations of the foregoing embodiment of the present invention.

In the foregoing embodiment, the front cover section 100 of the main apparatus body 10 includes as covering members the external cover panel 11A of the access cover 11 and the flat portions 12F, 13F of the first and second paper cassettes 12, 13. While the copying machine 1 of the embodiment is provided with the two paper cassettes 12, 13, the embodiment may be so modified as to include only one paper cassette, or three or more paper cassettes vertically stacked to form a multi-cassette configuration.

The above-described embodiment is an example in which the flat portion 11F of the external cover panel 11A has the vertically elongate rectangular shape to suggest the direction of access to the sheet output portion 30. This design of the embodiment may be so modified that the flat portion 11F of the external cover panel 11A has an upward narrowing triangular or trapezoidal shape to more clearly indicate the direction of access to the sheet output portion 30. Also, while the foregoing embodiment shows an example in which the flat portion 11F of the external cover panel 11A is located at the middle of the external cover panel 11A in the left-right direction, the embodiment may be so modified that the flat portion 11F located at other than the middle of the external cover panel 11A, or the external cover panel 11A has more than one flat portions formed thereon.

The foregoing embodiment is an example which employs black as a dark color and silver as a bright color. This is one illustrative example of the invention. The coloring scheme may be modified to use a combination of other colors. In this connection, it is to be pointed out that the dark color and the bright color to be combined should preferably have a difference in value (lightness) of 3 or larger in terms of Munsell value as defined by the Japanese Industrial Standard (JIS) Munsell chart.

The foregoing embodiment employs the handles 121, 131 of the first and second paper cassettes 12, 13 as an example of a "handle" of the present invention used for opening the covering members. Instead of, or in addition to, regarding the handles 121, 131 of the paper cassettes 12, 13 as the "handle(s)" of the invention, the recessed handle 113 gripped by the user when opening and closing the access cover 11 may be regarded the "handle(s)" of the invention. In this case, if the recessed handle 113 is located at a position shown in FIG. 1, a flat portion should preferably be formed in an area of the external cover panel 11A of the access cover 11 close to the right-hand end thereof.

The above-described structure of the access cover 11 may also be modified in various ways. For example, the access cover 11 may be so modified as to be swingable downwardly frontward with a pivot axis provided at a lower end of the access cover 11 or to have a two-way opening structure provided with doubles doors which can be swung out both leftward and rightward. In such modified form of the embodiment, the recessed handle 113 of the access cover 11 should be relocated to a suitable position and the flat portion be provided in the vicinity of the recessed handle 113.

The invention thus far discussed in detail with reference to the preferred embodiment and modifications thereof can be summarized as follows.

An image forming apparatus according to a principal feature of the invention comprises a main apparatus body having a boxlike structure incorporating in an internal space thereof an image forming block and a sheet feed section, an image reading block located above the main apparatus body, a sheet output portion provided with a sheet output tray onto which a sheet is ejected upon completion of image forming operation, the sheet output portion being located between the main apparatus body and the image reading block and opening at least frontward to permit retrieval of the sheet from the sheet output tray, and a front cover section provided on a front side of the main apparatus body, the front cover section including front openable covering members. The front cover section includes a striped portion having a surface in which ridges and furrows are formed and a flat portion having a flat surface, the flat portion including a first flat portion located in an area adjacent to the sheet output tray.

With the front cover section thus structured, the striped portion randomly reflects incident natural light and/or artificial light whereas the flat portion regularly reflects either the natural light or the artificial light. This arrangement permits the user to recognize the flat portion as a visually prominent portion in contrast to the striped portion. The provision of the flat portion adjacent to the sheet output tray makes it possible for the user to easily recognize the location of the sheet output portion.

This design of the invention helps provide enhanced ease of recognition of the internal output type sheet output portion as well as improved accessibility to the sheet output tray when the user retrieves output sheets therefrom upon completion of the image forming operation, for instance.

Preferably, the image forming apparatus further comprises a handle provided on at least one of the covering members as an aid to opening the at least one of the covering members, and the flat portion further includes a second flat portion located in an area behind the handle.

With the second flat portion located in the back of the handle, the user is allowed to easily recognize the location of the handle. This design of the invention serves to improve accessibility to the handle of the relevant covering member and operability thereof.

Preferably, the image forming apparatus further comprises a front openable access cover located below the sheet output portion to cover the image forming block, and a sheet cassette mounted in the main apparatus body below the access cover in such a way that the sheet cassette can be pulled out frontward, wherein the covering members of the front cover section include the access cover and an external cover panel of the sheet cassette, the external cover panel being provided on a front side of the sheet cassette and fitted with the handle, the first flat portion is provided in an area of the access cover adjacent to the sheet output portion, and the second flat portion is provided in an area of the external cover panel behind the handle.

The image forming apparatus provided with the access cover and the sheet cassette thus configured on the front side of the apparatus permits the user to easily recognize the location of the handle of the sheet cassette.

Preferably, the external cover panel has a third flat portion indicating a direction of access to the sheet output portion. Since the front cover section has the third flat portion indicating the direction of access to the sheet output portion in addition to the first flat portion located adjacent to the sheet output tray in this configuration, the user is allowed to more easily recognize the location of the sheet output portion.

In the image forming apparatus of the invention thus structured, it is preferable that the second and third flat portions be bright-colored and the rest of the front cover section be dark-colored. It is also preferable that the bright-colored and dark-colored areas of the front cover section have a difference in lightness of 3 or larger in terms of Munsell value as defined by the JIS Munsell chart. This kind of color arrangement provides further enhanced ease of recognition of the handle and the sheet output portion.

The third flat portion of the access cover and the second flat portion of the handle may be so arranged that the former contiguously connects to the latter to give an impression that these flat portions together extend and point to the sheet output portion. This feature of the arrangement of the flat portions serves to further enhance the ease of recognition of the sheet output portion.

Preferably, the image forming apparatus further comprises an operating portion mounted at the front of the image reading block, the operating portion having a bright-colored area in a front surface thereof. Still preferably, the image forming apparatus further comprises an automatic document feeder provided in the image reading block and configured to be swingable up and down, the automatic document feeder having a bright-colored area in a lift pull thereof. This kind of color arrangement serves to provide enhanced ease of recognition of the operating portion and the automatic document feeder.

In addition, the third flat portion of the access cover is preferably a most frontward protruding part on the front side of the main apparatus body.

As the third flat portion of the access cover is the most frontward protruding part on the front side of the main apparatus body in this structure, the third flat portion will come into contact with a nearby wall surface or the like when the image forming apparatus is hit thereagainst. If a collision or scratching contact between the front side of the main apparatus body and a wall surface or the like occurs, the most protruding third flat portion hits against such object, thereby preventing damage to other parts than the third flat portion of the access cover on the front side of the apparatus. This feature of the invention serves to protect those parts on the front side of the image forming apparatus other than the third flat portion during installation or relocation of the apparatus, for instance.

Still preferably, the third flat portion protrudes more frontward than a front side of the handle. This structure serves to protect the handle by preventing the same from hitting against the wall surface or the like.

Additionally, the third flat portion of the access cover is preferably used for displaying an emblem or the like. An emblem made of a hard material, if mounted on the third flat portion of the access cover, will help protect the other parts on the front side of the image forming apparatus.

This application is based on Japanese Patent Application No. 2007-337825 and 2007-337826 filed on Dec. 27, 2007, respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a main apparatus body having a boxlike structure containing an image forming block and a sheet feed section;

an image reading block located above said main apparatus body;

a sheet output portion provided with a sheet output tray onto which a sheet is ejected upon completion of image forming operation, said sheet output portion being located between said main apparatus body and said image reading block and opening at least frontward to permit retrieval of the sheet from the sheet output tray; and a front cover section provided on a front side of said main apparatus body, said front cover section including front openable covering members;

wherein said front cover section includes a striped portion having a surface in which ridges and furrows are formed and a flat portion having a flat surface, the flat portion including a first flat portion located in an area adjacent to the sheet output tray.

2. The image forming apparatus according to claim 1 further comprising a handle provided on at least one of the covering members as an aid to opening said at least one of the covering members, wherein the flat portion further includes a second flat portion located in an area behind said handle.

3. The image forming apparatus according to claim 2 further comprising:

a front openable access cover located below said sheet output portion to cover said image forming block; and a sheet cassette mounted in said main apparatus body below said access cover in such a way that said sheet cassette can be pulled out frontward;

wherein the covering members of said front cover section include said access cover and an external cover panel of said sheet cassette, the external cover panel being provided on a front side of said sheet cassette and fitted with said handle, the first flat portion is provided in an area of said access cover adjacent to said sheet output portion, and the second flat portion is provided in an area of the external cover panel behind said handle.

4. The image forming apparatus according to claim 3 wherein the external cover panel has a third flat portion indicating a direction of access to said sheet output portion.

5. The image forming apparatus according to claim 4 wherein the second and third flat portions are bright-colored and the rest of said front cover section is dark-colored.

6. The image forming apparatus according to claim 5 wherein the bright-colored and dark-colored areas of said front cover section has a difference in lightness of 3 or larger in terms of Munsell value as defined by the JIS Munsell chart.

7. The image forming apparatus according to claim 5 wherein the third flat portion of said access cover contiguously connects to the second flat portion of said handle, together extending toward said sheet output portion.

8. The image forming apparatus according to claim 5 further comprising an operating portion mounted at the front of said image reading block, said operating portion having a bright-colored area in a front surface thereof.

9. The image forming apparatus according to claim 5 further comprising an automatic document feeder provided in said image reading block and configured to be swingable up and down, said automatic document feeder having a bright-colored area in a lift pull thereof.

10. The image forming apparatus according to claim 4 wherein the third flat portion of said access cover is a most frontward protruding part on the front side of said main apparatus body.

11. The image forming apparatus according to claim 10 wherein the third flat portion protrudes more frontward than a front side of said handle.

12. The image forming apparatus according to claim 4 wherein the third flat portion of said access cover displays an emblem.

* * * * *